US006779683B2

(12) United States Patent
Taylor et al.

(10) Patent No.: US 6,779,683 B2
(45) Date of Patent: Aug. 24, 2004

(54) DISPENSER FOR DISPENSING SHEET MATERIAL

(75) Inventors: Antwain Demone Taylor, Suwanee, GA (US); Victoria L. Bischoff, Roswell, GA (US); Robert C. Ziegenfuss, Stone Mountain, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/137,478

(22) Filed: Apr. 30, 2002

(65) Prior Publication Data

US 2003/0201274 A1 Oct. 30, 2003

(51) Int. Cl.[7] ..... B65H 1/00
(52) U.S. Cl. ..... 221/61; 221/48; 221/47
(58) Field of Search ..... 221/61, 63, 62, 221/155, 48, 46, 47, 281

(56) References Cited

U.S. PATENT DOCUMENTS

| | | | | |
|---|---|---|---|---|
| 3,597,032 A | * | 8/1971 | Harangozo | 312/34.4 |
| 3,840,146 A | | 10/1974 | Bodek | |
| 4,953,747 A | | 9/1990 | Wenkman et al. | |
| 5,076,466 A | | 12/1991 | Petterson et al. | |
| 5,265,758 A | | 11/1993 | Saint Criq et al. | |
| 5,462,197 A | | 10/1995 | Pound | |
| 5,642,836 A | | 7/1997 | Merriweather, Jr. | |
| 5,697,576 A | | 12/1997 | Bloch et al. | |
| 5,868,342 A | | 2/1999 | Moody et al. | |
| 5,931,339 A | | 8/1999 | Dodge et al. | |
| 5,950,863 A | | 9/1999 | Schutz et al. | |
| 5,954,256 A | | 9/1999 | Niada | |
| 6,070,756 A | | 6/2000 | Dodge et al. | |
| 6,145,782 A | | 11/2000 | King et al. | |
| 6,170,698 B1 | | 1/2001 | Phelps et al. | |
| 6,230,929 B1 | * | 5/2001 | Phelps et al. | 221/46 |
| 6,257,443 B1 | | 7/2001 | LaCount | |
| 6,267,323 B1 | | 7/2001 | Phelps et al. | |
| 6,520,372 B2 | * | 2/2003 | Phelps | 221/34 |

FOREIGN PATENT DOCUMENTS

| | | |
|---|---|---|
| EP | 0729724 B1 | 10/1999 |
| GB | 1180434 | 2/1970 |
| WO | 97/09918 | 3/1997 |
| WO | 98/40002 | 9/1998 |
| WO | 99/33384 | 7/1999 |

* cited by examiner

*Primary Examiner*—Donald P. Walsh
*Assistant Examiner*—Kaitlin Joerger
(74) *Attorney, Agent, or Firm*—Sue C. Watson

(57) ABSTRACT

A dispenser for dispensing individual sheets of a paper product from a stack of sheets loaded in the dispenser includes a housing having an internal compartment configured to hold a stack of sheets, and at least one door coupled to the housing. The door provides access and closure to the internal compartment, and the door has at least a portion of a dispensing opening formed therein through which individual sheets are dispensed. The door is configured to move into the internal compartment to provide an opened loading position for loading a stack of sheets. The door is also configured to move into alignment with adjacent portions of the housing when in a closed dispensing position such that the door abuts adjacent portions of the housing to provide a closure and hides an entry point into the dispenser, thereby providing an illusory appearance of being an unmovable portion of the dispenser.

15 Claims, 8 Drawing Sheets

DISPENSER FOR DISPENSING SHEET MATERIAL

FIELD OF THE INVENTION

The invention generally relates to dispensers, and more specifically, to dispensers for dispensing sheet material.

BACKGROUND

Dispensers for dispensing individual sheets of paper products, for example, toilet tissue, from an internally stored stack of the products are known in the art. Commercial examples of such dispensers include the line of SaniTouch® bath tissue dispensers from Kimberly-Clark Corporation. The industry is continuously seeking ways to improve such dispensers, especially as to ease and reliability of use by the public, and simplicity and cost from a manufacturing standpoint.

Particular problems arise in use of such dispensers for stacks of relatively high absorbency and low tensile strength paper products, such as bath or toilet tissue. For example, when a maintenance technician over-fills or "stuffs" the dispenser upon refilling, the stack becomes compressed against the bottom dispensing surface and it becomes very difficult for a user to pull individual sheets out of the dispensing throat. The sheets will tear and the user is tempted to grasp and pull "clumps" of the product out of the dispenser, resulting in user waste. Preventing over-fill conditions is an ongoing issue.

Conventional dispensers also typically include front doors or panels that swing open to provide access for refilling the dispenser. Such a configuration for refilling paper products often contributes to the compression of the stack at the bottom of the dispensing surface. Further, the doors or panels must be secured via lock and key mechanisms to prevent vandalism. Such devices add to the manufacturing costs, must be serviced and maintained, and require maintenance personnel to keep track of keys and the like for opening the dispenser.

The industry is constantly seeking improved dispensers, particularly for dispensing stacked sheets of bath or toilet tissue. The present invention offers such an improved dispenser and addresses certain noted drawbacks of conventional dispensers.

Definitions

As used herein, the term "exit port" or "dispensing opening" is the opening in a housing of a dispenser for the passage of sheet material out of the dispenser.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, spring-loaded hinges, living hinges, and so forth. Living hinges may be constructed from plastic and other materials and formed integrally between two members. A living hinge permits pivotable movement of one member in relation to another connected member.

As user herein, the term "couple" includes, but is not limited to, joining, connecting, fastening, linking, or associating two things integrally or interstitially together.

SUMMARY OF THE INVENTION

In one aspect of the invention, a dispenser for dispensing individual sheets of a paper product from a stack of sheets loaded in the dispenser is provided. The dispenser has a housing having an internal compartment configured to hold a stack of sheets. The dispenser also has at least one door coupled to the housing. The door provides access and closure to the internal compartment. At least a portion of the door has a dispensing opening formed therein through which individual sheets are dispensed. The door is configured to move into the internal compartment to provide an opened loading position for loading a stack of sheets. The door is also configured to move into an alignment with adjacent portions of the housing when it is in a closed dispensing position such that the door abuts adjacent portions of the housing to provide a closure and to hide an entry point into the dispenser, thereby providing an illusory appearance of being an unmovable portion of the dispenser.

DETAILED DESCRIPTION

Figure 1:
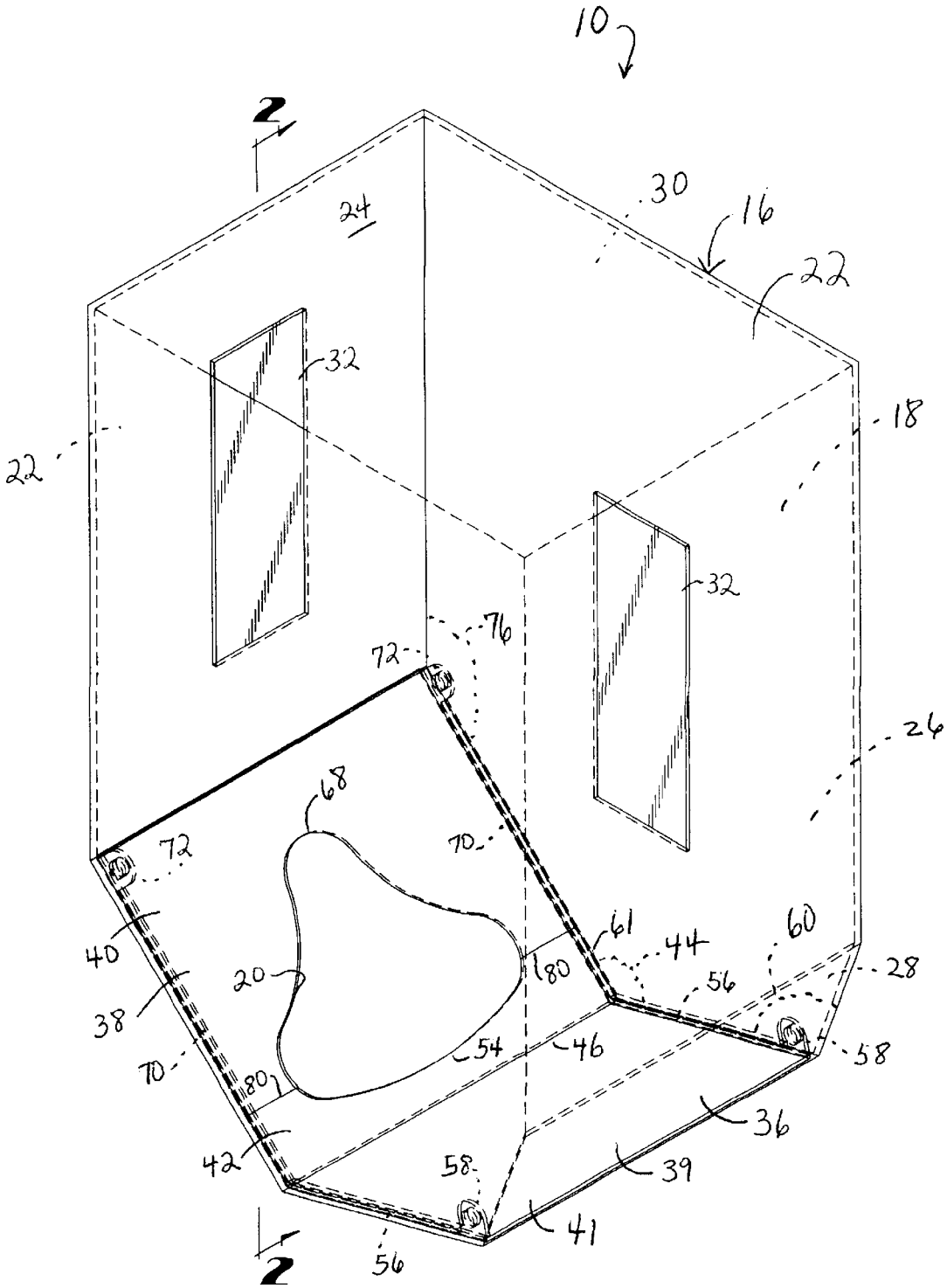
FIG. 1 is a perspective view of a dispenser for dispensing sheet material from the lower end of the dispenser, illustrating portions of the housing in phantom lines.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Figure 2:
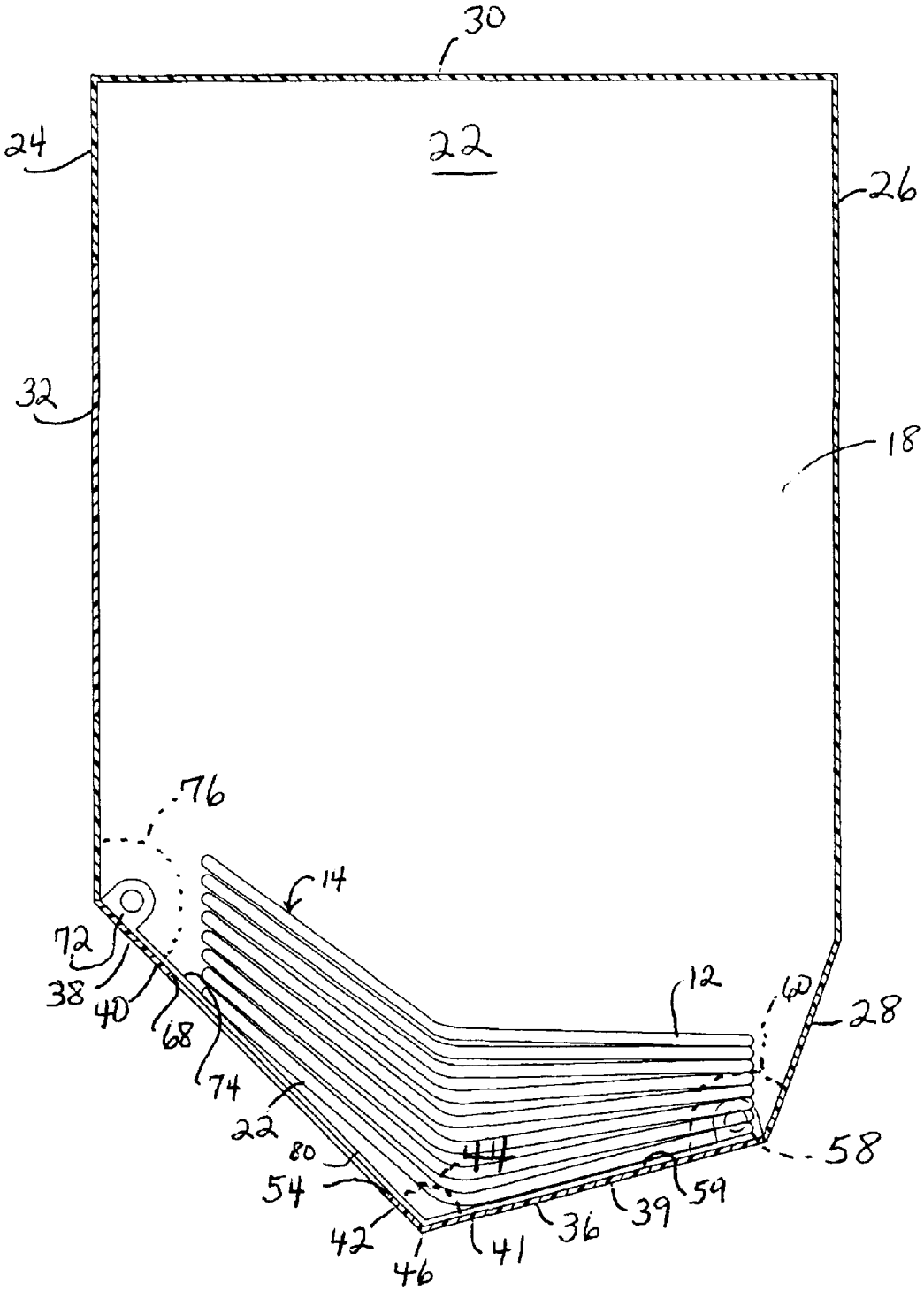
FIG. 2 is a sectional view of FIG. 1 taken along line 2—2.

Referring now to FIGS. 1–5 in general, a dispenser 10 is provided for dispensing individual sheets 12 of a paper product from a stack 14 of the sheets 12 loaded into the dispenser 10, as shown in FIGS. 1–2. The dispenser 10 includes a housing, generally 16, defining an internal compartment 18 with a dispensing opening 20 therein. The housing 16 is not a limiting feature of the invention and may take on any shape or configuration. In addition, the housing 16 may be made of any suitable material(s).

The housing includes a pair of side walls 22, a front wall 24, and a back wall 26 having a lower angled section 28. A top plate 30 is coupled to, or formed integrally with, an upper end of side walls 22, front wall 24 and back wall 26. One or more windows 32 may be provided in any of the walls. The windows 32 and/or any portion of the housing 12 may be formed from a clear, tinted, or translucent material, so that a maintenance technician can easily view the quantity of sheets 12 left in the internal compartment 18 of the housing 12. A first door 36 and a second door 38 provide generally a lower end 39 of the housing 12. The second door 38 and a portion of the first door 36 come together to provide a planar surface or a dispensing plate 40, in which the dispensing opening 20 if formed.

It will be appreciated that in the present embodiment, the housing 16 is configured to follow generally the shape and size of the stacks 14 of sheets 12. Other configurations may be used, however, to accommodate aesthetic and/or functional considerations.

Figure 3:
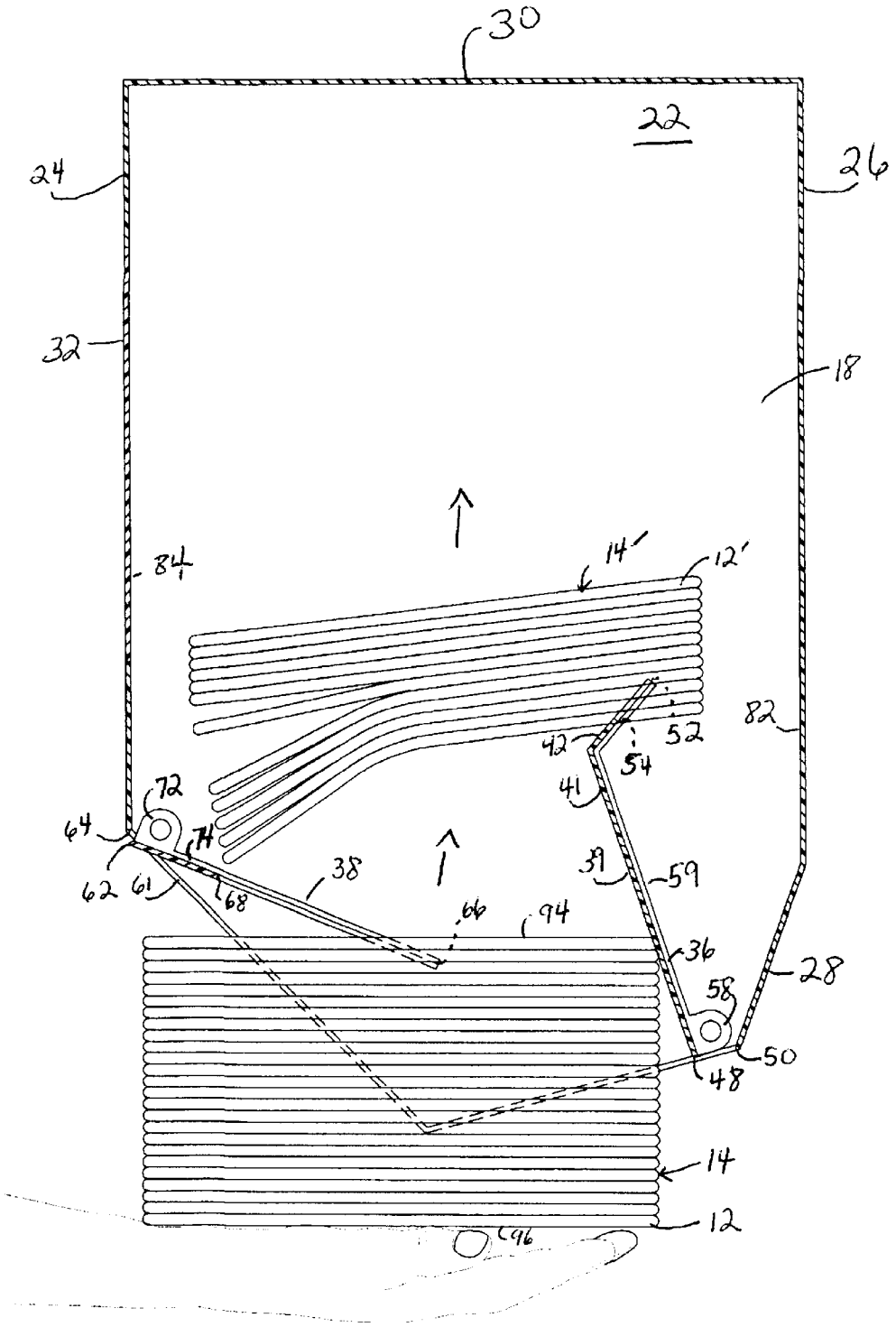
FIG. 3 is a sectional view similar to FIG. 2, but showing first and second doors opening inward and carrying previously loaded stack of sheets upward into the internal compartment to provide space for an additional stack of sheets to be loaded therein.

The first door 36 includes first and second sections 41, 42, as shown in FIGS. 1–5. First and second sections 41, 42 are constructed and positioned, but not by way of limitation, at an obtuse angle 44 relative to each other, and are connected at a junction 46. The first section 41 includes a back edge 48 which abuts a lower end 50 of the lower angled section 28 of the back wall 26 (FIG. 3). At an opposite end, the second section 42 includes a front edge 52 having a concave curved portion 54 which forms a portion of the dispensing opening 20. First and second sections 41, 42 also include opposite side edges 56. The first door 36 is coupled to the side walls 22 via a pair of hinges 58. The hinges 58 are each coupled to a side wall 22 and are also coupled to an upper surface 59 of the first door 36, one hinge 58 each being positioned near a corner at the junction of one side edge 56 and the back edge 48 of the first door 36. The hinges 58 create a dispensing angle 60 for the first door 36. That is, the angles 44, 60 of the first door 36, in part by the configuration of the first door 36 and in part by its positioning by the hinges 58 adjacent each lower end 61 of each side wall 22, permits one of each of the side edges 56 of the first door 36 to be positioned adjacent one of each of the lower ends 61 of the side walls 22, so that the edges 56 of the first door 36 conform to the contours of the lower ends 61 of the side walls 22. The use of first and second sections 41, 42, is non-limiting, and alternatives include only a single section, more than two sections, and so forth, as long as the first door 36 is positioned closely to adjacent portions of the housing 12 and therefore desirably provides at least an initial appearance of being integrally formed with the adjacent housing 12.

Similarly, the second door 38 includes a front edge 62 which abuts a lower end 64 of the front wall 24, as illustrated in FIGS. 1–5. The second door 38 includes a back edge 66 desirably having a curved section 68, such as but not by way of limitation, a rounded V-shape curve, a rounded U-shape curve, and so forth. The curved section 68 forms a part of the dispenser opening 20 and provides a portion of the dispensing opening 20 in which a user may use a thumb and finger to better permit a user to grasp sheets 12 between the thumb and finger for removal from the dispenser 10. It will be understood that the shape of the dispensing opening 20 is non-limiting, and any configuration and/or size of opening may be used, so long as sheets 12 are readily, but not excessively, dispensed therethrough. The second door 38 also includes opposing side edges 70.

The second door 38 is also coupled to the sidewalls 22 via a pair of hinges 72. The hinges 72 are each coupled to a side wall 22 and are also coupled to an upper surface 74 of the second door 38, and one hinge 72 is positioned near a corner at the junction of one side edge 70 and the front edge 62 of the second door 38. The hinges 72 create an obtuse dispensing angle 76 for the second door 38 relative to the front wall 24 and the side walls 22. The angle 76 of the second door 38, in part by the configuration of the second door 38 and in part by its positioning by the hinges 72 along each of the lower ends 61 of the side walls 22, permits one of each of the side edges 70 of the second door 38 to be positioned adjacent to one of each of the lower ends 61 of the side walls 22, so that the side edges 70 of the second door 38 conform to the contours of the lower ends 61 of the side walls 22.

Figure 5:
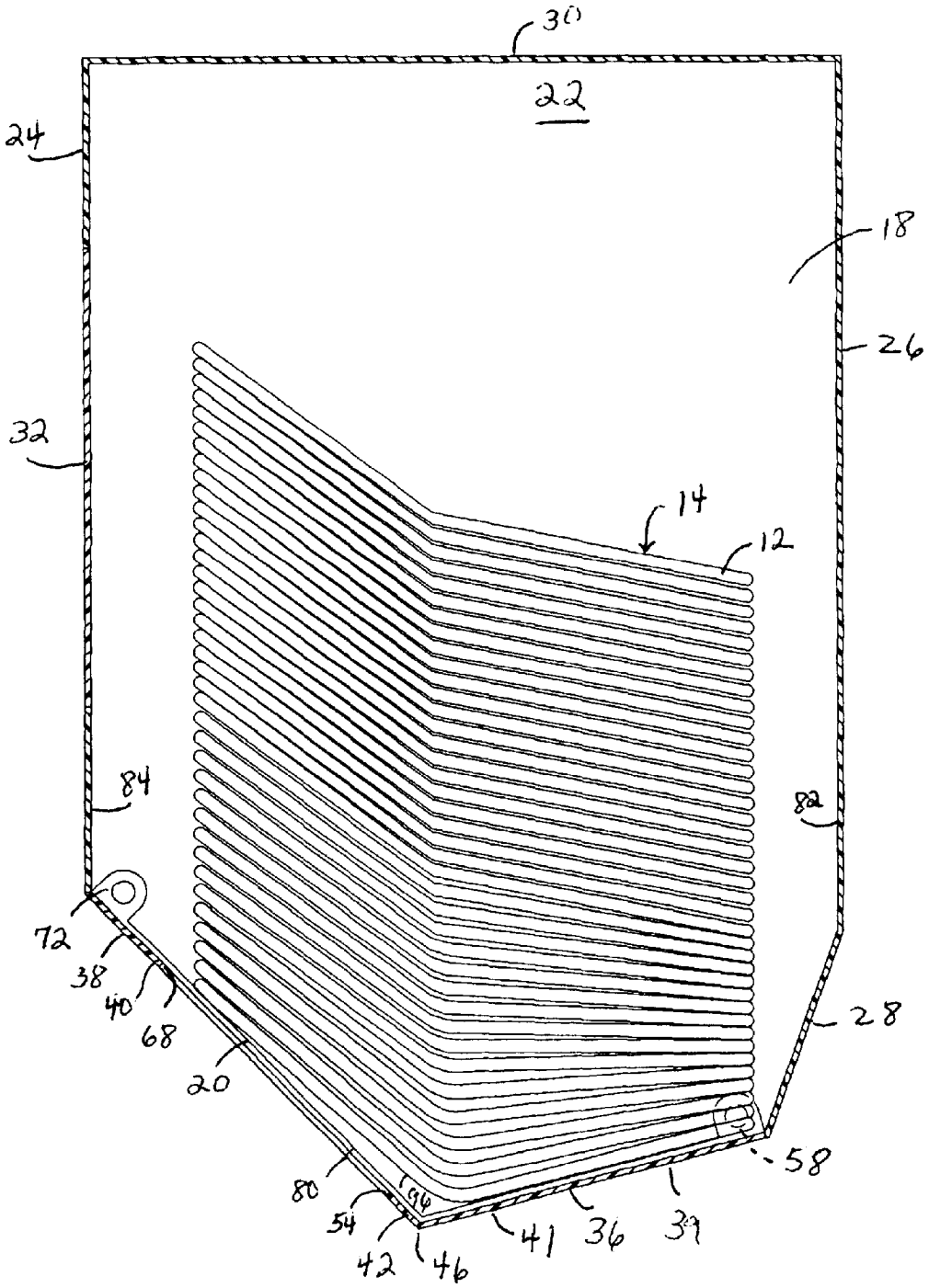
FIG. 5 is a sectional view similar to FIG. 2, but showing the newly loaded stack of sheets and the previously loaded stack of sheets combined in the dispenser and uncompressed for dispensing, a lower end of the stack of sheets being positioned against the first and second doors for dispensing.

The front edge 52 of the second section 42 of the first door 36 abuts the back edge 66 of the second door 38, and the first and second doors 36, 38 cooperate to provide the planar surface or dispensing plate 40, as shown in FIGS. 1, 2 and 5. Similarly, the contours of the concave curved portion 54 of the second section 42 cooperate with the contours of the curved section 68 of the second door 38 to provide the dispensing opening 20. A line of abutment 80 is provided at the junction of the front and back edges 52, 66. The line of abutment 80 provides a close contact and closure between the front and back edges 52, 66 of the first and second doors 36, 38 and also provides an appearance of only a minor "seam" or manufacturing line in an otherwise planar surface. This appearance provides the illusion generally that the dispensing plate 40 is a single integral planar surface, and not two hinged doors which provide access into the internal compartment 18 of the housing 12, thereby hiding the access into the internal compartment 18. Further, the positioning of the first and second doors 36, 38 with respect to the housing 12 also provides the illusory appearance that the planar surface or dispensing plate 40 are integrally formed with the adjacent portions of the housing 12. That is, the side edges 56 of the first door 36 and the edges 70 of the second door 38 are positioned adjacent to the lower ends 61 of the side walls 22. The back edge 48 and the front edge 62 of the first and second doors 36, 38 abuts the lower ends 50, 64 of the lower angled section 28 of the back wall 26 and the front wall 24, respectively. This abutment desirably provides an overall illusion or illusory appearance of the first and second doors 36, 38, being integrally formed with, or, at least, being fixedly coupled to, the housing 12, to prevent tampering and vandalism of the dispenser 10. Such a mechanism, however, also provides easy loading of additional stacks 14 of sheets 12 into the internal compartment 18 of the housing 12, without having to un-latch or un-lock at least a portion of the housing 12 and/or the first and second doors 36, 38, to do so. In addition, this mechanism prevents over-filling of the internal compartment 18 of the housing 12, resulting in improved dispensing of the sheets 12.

Figure 4:
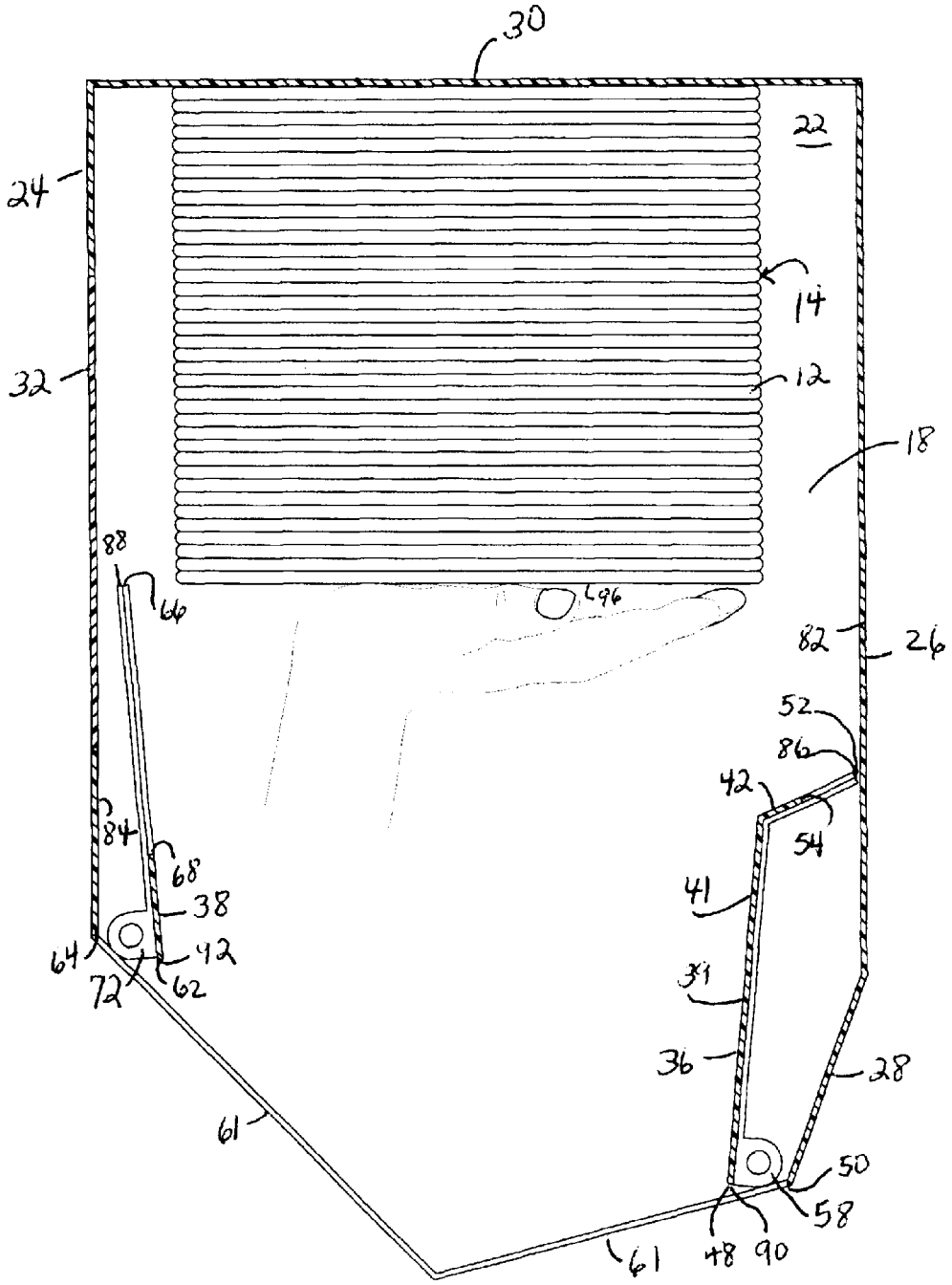
FIG. 4 is a sectional view similar to FIG. 3, but showing the stack of newly loaded sheets and the stack of previously loaded sheets being compressed further upward to provide a clearance position so that the first and second doors may be moved back into a closed dispensing position, the first and second doors being in an opened loading position.

Hinges 58, 72 prevent first and second doors 36, 38, respectively, from moving lower than the lower edges 61 of the side walls 22. Each side walls 22, may also have a lip, a flange, and so forth, which limits the first and second doors 36, 38 movement (not shown). Hinges 58, 72 are configured to permit the first and second doors 36, 38 to pivotably move upward, into the internal compartment 18 of the housing 12, to allow stacks 14 of sheets 12 to be loaded into the internal compartment 18. First and second doors 36, 38 pivot on hinges 58, 72, respectively and move upwardly, as shown in FIGS. 3 and 4, so that an upper surface 59 of the first door 36 is generally positioned adjacent an inner surface 82 of the back wall 26, and an upper surface 74 of the second door 38 is generally positioned adjacent an inner surface 84 of the front wall 24, each first and second door 36, 38, being desirably, in the present embodiment, positioned in a generally vertical position. The front edge 52 of the first door 36 and the back edge 66 of the second door 38 are each positioned superior relative to the rest of the first and second doors 36, 38, respectively, to provide upper ends 86, 88, of the first and second doors 36, 38, respectively when in an opened, loading position. Similarly, when the first and second doors 36, 38 are in the opened, loading position, the back edge 48 of the first door 36 and the front edge 62 of the second door 38 are positioned in an inferior position relative to the upper ends 86, 88, and therefore provide lower edges 90, 92 of the first and second doors 36, 38, respectively.

The position of each of the first and second doors 36, 38 provides a sufficient opening and access into the internal compartment 18 for loading of additional stacks 14 of sheets 12. The limited length of each of the first and second doors 36, 38, as they extend into the internal compartment 18 provides sufficient clearance thereabove so that a substantial stack 14 of sheets 12 may be loaded into the internal compartment 18 by a maintenance technician. The clearance required for the first and second doors 36, 38 to move back into a closed, dispensing position, provides the space required within the internal compartment so that the sheets 12, which may be compressed during the loading procedure, have sufficient space to un-compress after being loaded. In this manner, an effective number of sheets 12, i.e., desirably, one or two sheets at a time, are dispensed through the dispensing opening 20, without excessive tearing and/or "clumping" of sheets and waste. Such "clumping" and waste commonly occurs when stacks of sheets are loaded into a dispenser to completely fill the internal compartment of a dispenser, the sheets being overly compressed when a dispenser is completely filled in such a manner.

To load the dispenser 10, as illustrated generally in FIGS. 3–5, a maintenance technician places a sufficient stack 14 of sheets 12 in one hand, and generally aligns the stack 14 with the first and second doors 36, 38 of the housing 12. The maintenance technician desirably pushes the first and second doors 36, 38, as illustrated in FIG. 3. The front edge 52 of the first door 36 and the back edge 66 of the second door 38 pivotably moves upward and inward into the internal compartment 18 of the housing 12, while the back edge 48 and the front edge 62 of the first and second doors 36, 38, pivotably rotate on hinges 58, 72, respectively. As shown in FIGS. 3 and 4, as the front edge 52 and the back edge 66 move upward, they pushing any existing stack 14' of sheets 12' within the internal compartment 18 upward as well. The first and second doors 36, 38, move to a position adjacent the inner surfaces 82, 84 of the back wall 26 and the front wall 24, respectively, in an opened, loading position, as shown in FIG. 4. The maintenance technician continues to move the stack 14 of sheets 12 upward into the internal compartment 18, past the first and second doors 36, 38. The remaining stack 14' of sheets 12' in the internal compartment 18 is now positioned upon an upper end 94 of the newly loaded stack 14 of sheets 12, and both stack 12' and stack 12 are desirably moved upward and compressed against the top plate 30 during loading. Such compression permits a lower end 96 of the newly loaded stack 14 of sheets 12 to move into a clearance position above the upper ends 86, 88 of the first and second doors 36, 38 such that no sheets 12 extend below the upper ends 86, 88 to block the closure of the first and second doors 36, 38 into the closed, dispensing position. The clearance position permits the first and second doors 36, 38 to easily move back into a closed, dispensing position and also prevents over-filling of sheets 12 in the internal compartment 18, as illustrated in FIG. 4. When the combined stack 14 of sheets 12 are in the clearance position, the hand of the maintenance technician is withdrawn, permitting the first and second doors 36, 38 to pivotably move back into the closed, dispensing position, as shown in FIG. 5.

As the first and second doors 36, 38, close, the combined stack 14 of sheets 12 un-compress, and the lower end 96 of the stack 14 of newly loaded sheets 12 moves downward, in a position against the upper surfaces 59, 74 of the first and second doors 36, 38, and adjacent the dispensing opening 20. In the closed dispensing position, the first and second doors 36, 38 again cooperate to form the dispensing plate 40 and the dispensing opening 20. The first and second doors 36, 38 also cooperate with each other and all of the surrounding structures of the housing 12, as previously illustrated and described herein, to provide an appearance of being integrally formed with, or, at least, fixedly coupled to, the housing 12.

It will be understood that a single door, or more than two doors may be used, so long as the features of the invention, as illustrated and described herein, are retained. In addition, a latch and/or lock mechanism may be used to secure one or more doors. Such latch and/or lock mechanisms are known in the art.

Figure 6:
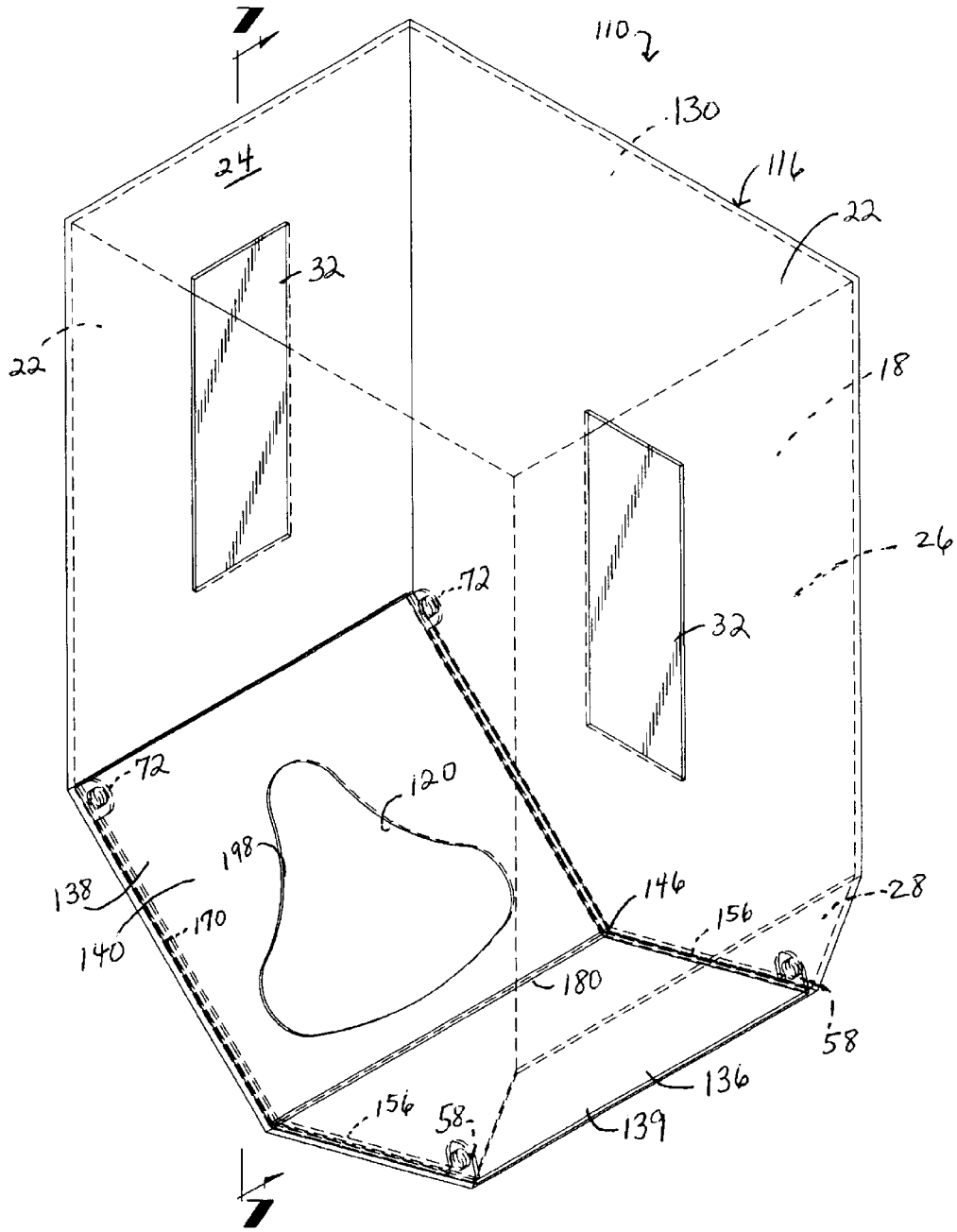
FIG. 6 is another perspective view of a dispenser for dispensing sheet material from the lower end of the dispenser, illustrating portions of the housing in phantom lines.
Figure 7:
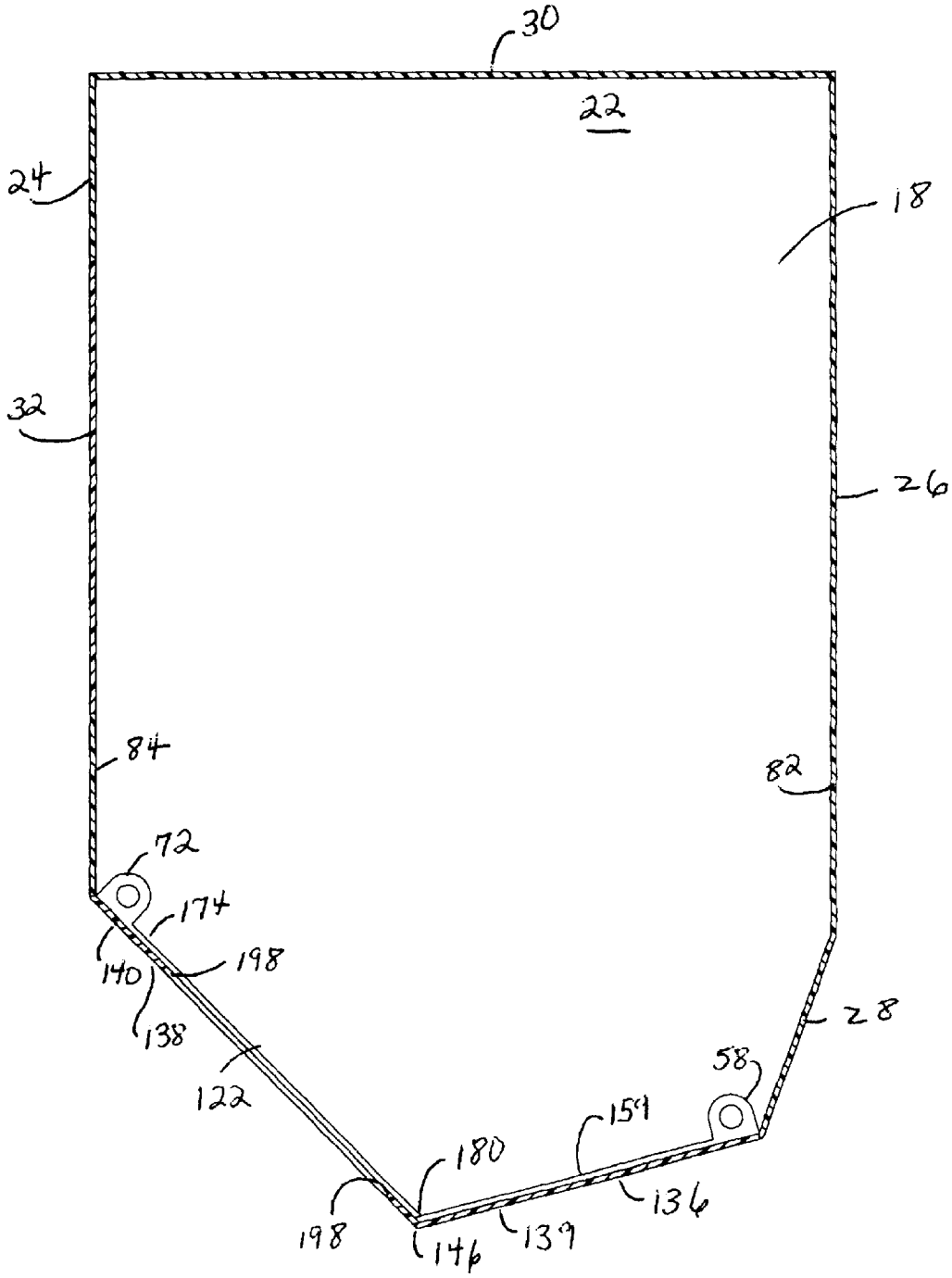
FIG. 7 is a sectional view of FIG. 6 taken along line 7—7, and showing a first and second door of the dispenser in a closed, dispensing position.
Figure 8:
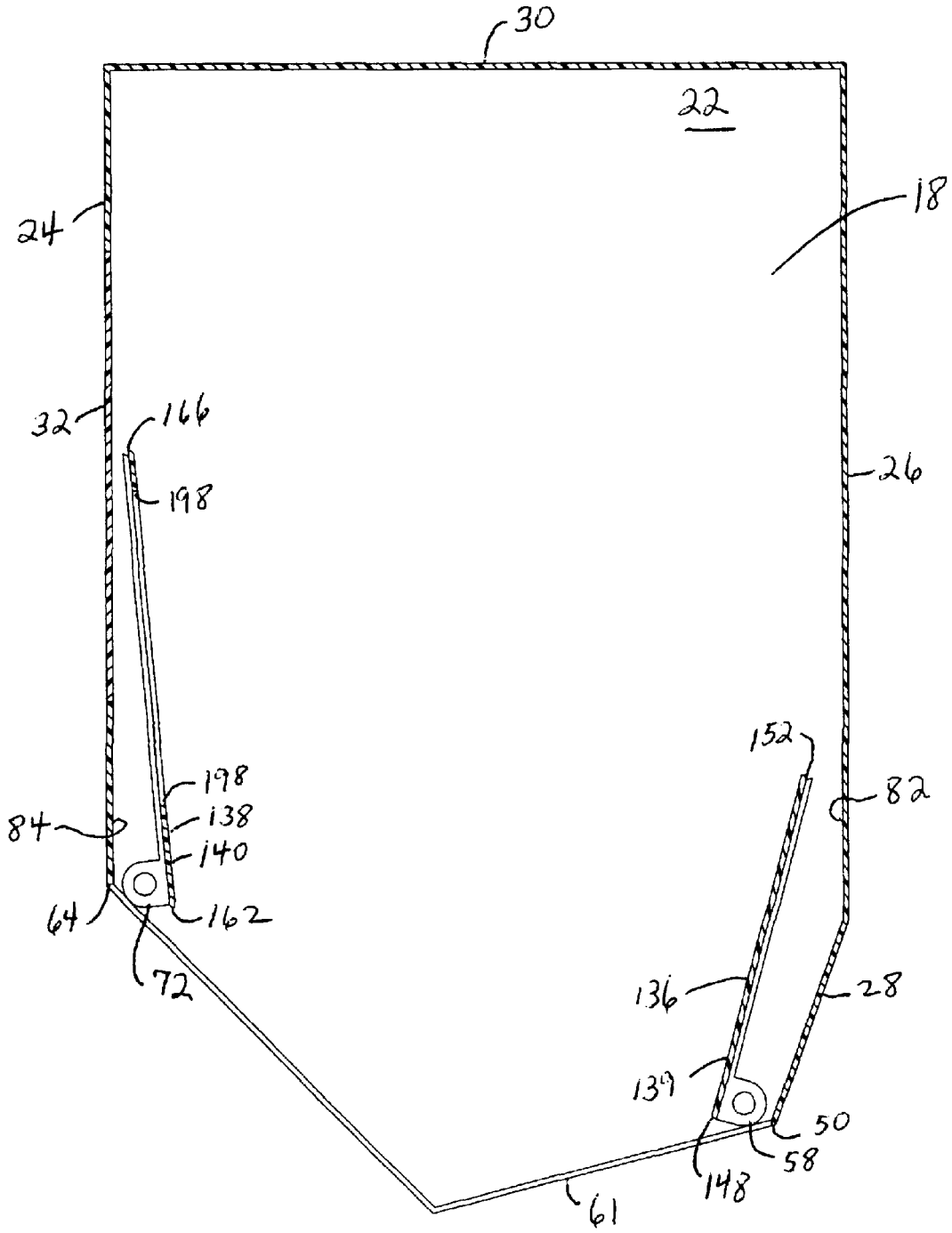
FIG. 8 is a sectional view similar to FIG. 7, but showing the first and second doors of the dispenser in an opened, loading position.

In another embodiment of the invention, as illustrated in FIGS. 6–8, the dispenser 110 provided is similar to the dispenser 10. The dispenser 110 differs from its counterpart dispenser 10 in that it has a first door 136 which generally provides a lower end 139 and a second door 138 which generally provides a dispensing plate 140 having a dispensing opening 120 formed therein. The dispensing opening 120 has a perimeter edge 198 which, in a non-limiting configuration, is configured to accommodate a user's thumb and finger to withdraw sheets therefrom, although any configuration may be utilized. As shown in FIGS. 6 and 7, the first and second doors 136, 138 abut at a junction 146.

The first and second doors 136, 138 abut at a front edge 152 and a back edge 164, respectively, providing a line of abutment 180 at the junction 146. The first and second doors 136, 138 each have a back edge 148 and a front edge 162 which abut the lower ends 50, 64 of the lower angled section 28 of the back wall 26 and the front wall 24, respectively. The first and second doors 136, 138 are coupled to the side walls 22 via hinges 58, 72, respectively, which are coupled to side walls 22 and which are also mounted on upper surfaces 159, 174 of the first and second doors 136, 138, respectively. The first and second doors 136, 138 pivotably move upward and inward into the internal compartment 18 of the housing 116, and are positioned adjacent the inner surfaces 82, 84, of the back wall 26 and the front wall 24, respectively, to provide an opened, dispensing position in which to load stacks 14 of sheets 12, as illustrated in FIG. 8. The first and second doors 136, 138, pivotably move to return to a closed, dispensing position (FIGS. 6 and 7). In the closed, dispensing position, the opposite sides 156, 170 of the first and second doors 136, 138, respectively, are positioned adjacent the lower ends 61 of the side walls 22, while the front end 152 and the back end 164 of the first and second doors 136, 138 cooperate at the line of abutment 180 to provide a closure, and to provide an illusion or illusory appearance that the first and second doors 136, 138, and therefore the dispensing plate 140 and the lower end 139 are integrally formed with, or, are at least fixedly coupled to, the housing 116 to discourage or prevent tampering and vandalism of the dispenser 110. It will be understood that the method of loading stacks 14 of sheets 12 in the dispenser 110, and use of the dispenser 110 in the present embodiment is generally the same as described and illustrated previously herein for dispenser 10. It will also be appreciated that the dispenser 110 generally has other features and characteristics previously described and shown herein of dispenser 10.

The door or doors provided in either dispenser, or any variation thereof, are each intended to be "hidden" as doors to a user, thereby hiding an entry point or a point of access into the internal compartment of the dispenser. Instead, the door or doors provide an illusion or illusory appearance of being a solid and unmovable component of the dispenser, such as a fixed dispensing plate, a fixed side wall, a fixed lower end, and so forth, to the casual observance of a user. That is, a user, observing and using the dispenser, would believe that the first and second door, and any portions thereof, are either integrally formed with the dispenser housing, or fixedly coupled to the dispenser housing in such a manner to prevent tampering or vandalism. In this manner, the dispenser provides the illusion or illusory appearance to a user that the sheet product is available to the user only through the dispensing opening.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for dispensing individual sheets of a paper product from a stack of sheets loaded in the dispenser, comprising:

a housing having sidewalls and an internal compartment configured to hold a stack of sheets; and a pair of doors pivotably coupled to the sidewalls of the housing and providing access and closure to the internal compartment, at least one of the pair of doors having at least a portion of a dispensing opening formed therein through which individual sheets are dispensed, each door configured be of limited length so as to provide sufficient clearance thereabove when pivotably moved into the internal compartment in an opened loading position such that a substantial stack of sheets is easily moved into a clearance position above a free end of each door, the doors configured to each pivotably move into alignment with adjacent portions of the housing when in a closed dispensing position, each door having a pivotable end and the free end, each pivotable end not in contact with the front and back wall of the housing when in the opened and loading position and each pivotable end in contact with the housing when in the dispensing position, the free ends of each door abutting in the dispensing position to hide an entry point into the dispenser and to provide an illusory appearance of being an unmovable portion of the dispenser.

2. The dispenser of claim 1, wherein each of free end of each door abuts in the dispensing position to cooperate to form an obtuse angle at the abutment of the two doors.

3. The dispenser of claim 1, wherein each free end of each door abuts in the dispensing position to cooperate to form a planar surface at the abutment of the two doors.

4. The dispenser of claim 1, wherein the pair of doors includes a first door and a second door, the pivotable end of the first door configured to be positioned against a portion of a back wall when the first door is moved into a dispensing position, the pivotable end of the second door configured to be positioned against a portion of a front wall when the second door is moved into a dispensing position.

5. The dispenser of claim 1, wherein each of the doors moves into the internal compartment when positioned in the opened loading position, the pivotable end of each door being positioned in the internal compartment and away from the housing, the free end of each door being positioned in the internal compartment.

6. The dispenser of claim 1, wherein the clearance position provides a clearance space, so that when the doors are moved into the closed dispensing position, the newly loaded stack of sheets moves down, adjacent the doors for dispensing and the clearance space prevents the stack of sheets from being compressed in the dispenser.

7. A dispenser for dispensing individual sheets of a paper product from a stack of sheets loaded in the dispenser, comprising:

a housing having an internal compartment configured to hold a stack of sheets; and a pair of doors coupled to the housing and providing access and closure to the internal compartment, the door having at least a portion of a dispensing opening formed therein through which individual sheets are dispensed, the door having a free end and a pivotable end, the free end and the pivotable end configured to move into the internal compartment to provide an opened loading position for loading a slack of sheets, the door configured to move into alignment with adjacent portions of the housing when in a closed dispensing position such that the door abuts adjacent portions of the housing to provide a closure and to hide an entry point into the dispenser, thereby providing an illusory appearance of being an unmovable portion of the dispenser.

8. The dispenser of claim 7, wherein the at least one door is further defined as a pair of doors, and wherein each of the doors includes a pivotable end and a free end.

9. The dispenser of claim 8, wherein each of free end of each door abuts in the dispensing position to cooperate to form an obtuse angle at the abutment of the two doors.

10. The dispenser of claim 9, wherein each free end of each door abuts in the dispensing position to cooperate to form a planar surface at the abutment of the two doors.

11. The dispenser of claim 7, wherein the clearance position provides a clearance space, so that when the doors are moved into the closed dispensing position, the newly loaded stack of sheets moves down, adjacent the doors for dispensing and the clearance space prevents the stack of sheets from being compressed in the dispenser.

12. A dispenser for dispensing individual sheets of a paper product from a stack of sheets loaded in the dispenser, comprising:

a housing having an internal compartment configured to hold a stack of sheets; and a pair of doors coupled to the housing providing access and closure to the internal compartment, the doors each having a pivotable end pivotably coupled to a portion of the housing and a free end, the pivotable end and the free end movable into the internal compartment when positioned in an opened loading position, at least a portion of one door having portion of a dispensing opening formed therein, at least a portion of each free end positioned in an abutting position relative to each other when the doors are positioned in a closed dispensing position, the doors in the abutting position configured to provide a point of entry into the internal compartment when the doors are moved into the internal compartment to provide an opened loading position, the abutting position of the doors hiding the point of entry when the doors are in a closed dispensing position and the doors positioned adjacent other portions of the dispenser such that the doors provide an outward illusory appearance to a user of being an unmovable portion of the dispenser to prevent tampering or vandalism by a user wherein at least a portion of each free end of each door abuts in the dispensing position to cooperate to form one of an obtuse angle and a planar surface at the abutment of the two doors.

13. The dispenser of claim 12, wherein the pair of doors includes a first door and a second door, the pivotable end of the first door configured to be positioned against a portion of a back wall when the first door is moved into a dispensing position, the pivotable end of the second door configured to be positioned against a portion of a front wall when the second door is moved into a dispensing position.

14. The dispenser of claim 12, wherein the pivotable end of each door is positioned in the internal compartment and away from the housing when each door is positioned in the opened loading position.

15. The dispenser of claim 14, wherein when the doors are positioned in the internal compartment, a clearance position is provided above the free ends and a clearance space is provided, so that when the doors are moved into the closed dispensing position, the newly loaded stack of sheets moves down, adjacent the doors for dispensing and the clearance space prevents the stack of sheets from being compressed in the dispenser.

* * * * *